US008141272B2

(12) United States Patent
Hay et al.

(10) Patent No.: US 8,141,272 B2
(45) Date of Patent: Mar. 27, 2012

(54) SHOE SOLE WITH PIVOTAL GROUND ENGAGING PLATE

(75) Inventors: Gordon G. Hay, Marblehead, MA (US); Keith M. Orr, Boston, MA (US); Derek Carroll, Marblehead, MA (US)

(73) Assignee: Bivab, LLC, Marblehead, MA (US)

( * ) Notice: Subject to any disclaimer, the term of this patent is extended or adjusted under 35 U.S.C. 154(b) by 885 days.

(21) Appl. No.: 11/914,987

(22) PCT Filed: May 19, 2006

(86) PCT No.: PCT/US2006/019366

§ 371 (c)(1),
(2), (4) Date: Nov. 20, 2007

(87) PCT Pub. No.: WO2006/127427

PCT Pub. Date: Nov. 30, 2006

(65) Prior Publication Data

US 2008/0196272 A1 Aug. 21, 2008

Related U.S. Application Data

(60) Provisional application No. 60/683,225, filed on May 20, 2005.

(51) Int. Cl.
*A43B 13/00* (2006.01)
*A43B 13/12* (2006.01)

(52) U.S. Cl. ..... 36/25 R; 36/28; 36/35 R

(58) Field of Classification Search ..... 36/28, 129, 36/29, 35 B, 35 R

See application file for complete search history.

(56) References Cited

U.S. PATENT DOCUMENTS

| | | | | | |
|---|---|---|---|---|---|
| 4,364,188 | A | * | 12/1982 | Turner et al. | 36/31 |
| 4,887,367 | A | | 12/1989 | Mackness et al. | |
| 4,972,611 | A | * | 11/1990 | Swartz et al. | 36/28 |
| 5,195,257 | A | * | 3/1993 | Holcomb et al. | 36/28 |
| D334,463 | S | * | 4/1993 | Chang | D2/968 |
| 5,493,791 | A | * | 2/1996 | Kramer | 36/28 |
| 5,853,844 | A | * | 12/1998 | Wen | 428/119 |
| 5,881,478 | A | * | 3/1999 | McMahon et al. | 36/144 |
| 6,880,267 | B2 | * | 4/2005 | Smaldone et al. | 36/28 |
| 7,213,354 | B1 | * | 5/2007 | Byrd et al. | 36/136 |
| 2004/0068892 | A1 | | 4/2004 | Wang | |

FOREIGN PATENT DOCUMENTS

GB 2203025 A 10/1988

* cited by examiner

*Primary Examiner* — Jila Mohandesi
(74) *Attorney, Agent, or Firm* — Davis & Bujold, PLLC

(57) ABSTRACT

A shoe sole comprising a foot engaging plate for accommodating a foot of a user and a ground engaging surface/plate. The foot engaging plate is sufficiently rigid so as to resist distortion of the foot engaging plate, during use of the shoe sole, so that the foot remains supported by the foot engaging plate during use of the shoe sole. A pivot member is located between the foot engaging plate and the ground engaging surface/plate to facilitate relative pivoting motion between the foot engaging plate and the ground engaging surface/plate. A layer of resilient material is sandwiched between the foot engaging plate and the ground engaging surface/plate. The resilient material may have one or more bores formed therein which accommodate a compressible material therein to facilitate programming of a desired compression characteristic for the shoe sole.

19 Claims, 11 Drawing Sheets

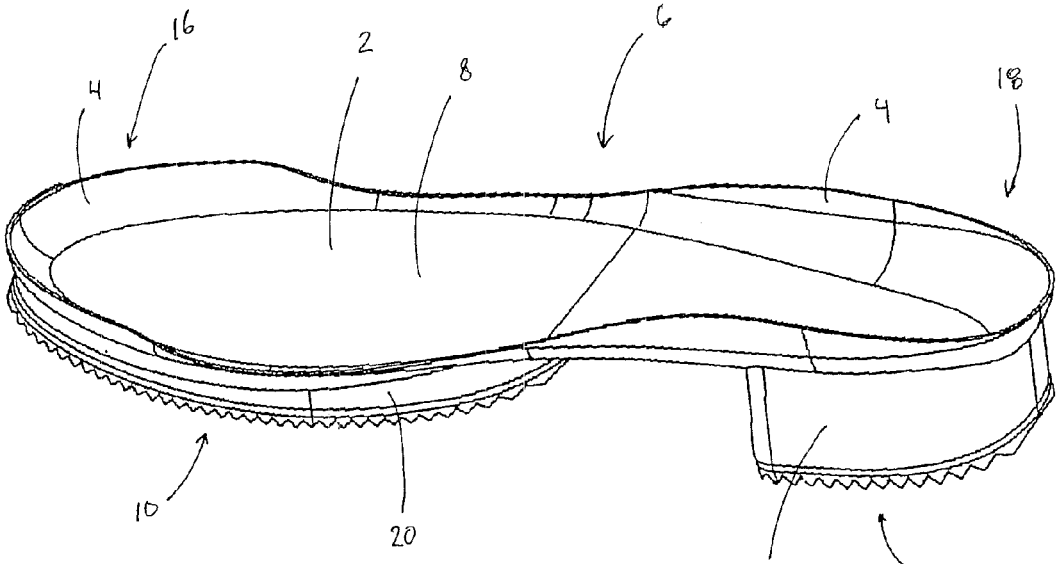
FIG. 3
FIG 3B
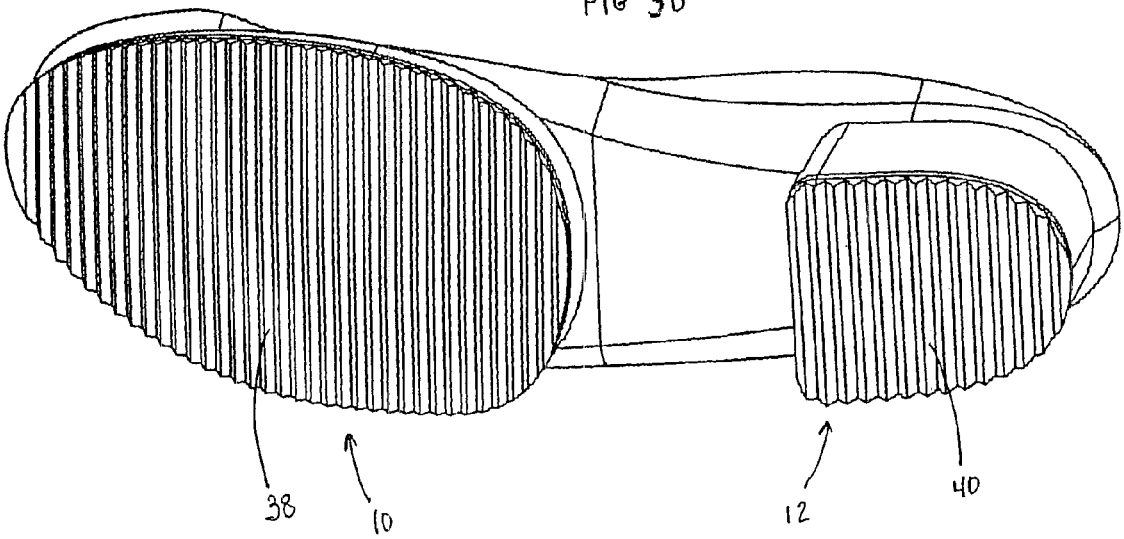

SHOE SOLE WITH PIVOTAL GROUND ENGAGING PLATE

FIELD OF THE INVENTION

The present invention relates to improvements concerning shoe soles and, in particular to a shoe sole with at least one pivotal ground or surface engaging plate located therein.

BACKGROUND OF THE INVENTION

While a variety of shoe soles are known in the art, many of the current designs do not facilitate maintaining the foot in a properly oriented position during use of footwear or a shoe sole while the undersurface of the shoe sole is adapted to accommodate variations in the terrain upon which the footwear or shoe sole is being used. In addition, none of the footwear or shoe soles hereto known allows the internal structure of the shoe sole to be readily changed and/or programmed to suit a particular type of activity that the shoe sole will commonly experience.

SUMMARY OF THE INVENTION

Wherefore, it is an object of the present invention to overcome the above mentioned shortcomings and drawbacks associated with the prior art.

Another object of the present invention is to provide a rigid foot support plate for supporting substantially the entire foot of the user and stabilizing the foot of a user during use of the shoe sole while pivotally attaching at least one other plate to a bottom surface of the foot support plate and allowing the bottom plate to pivot relative to the foot support plate and compensate for variations in the terrain, during use of the shoe sole, while still maintaining the foot in a relatively stable position.

A further object of the present invention is to minimize movement of the foot relative to the foot support plate, during use of the shoe sole, so that the foot remains in a substantially stable position at all times whereby the shoe sole correctly supports the heel, the arch and the ball of the feet of a user during use of the shoe sole.

Yet another object of the present invention is to provide one or more programming features or components, located between the top foot support plate and the bottom ground engaging plate, which facilitate altering the pivoting characteristics of the shoe sole so that the shoe sole is specifically adapted to respond, in a desired manner, or compensate for a desired motion during use of the shoe sole.

A still further object of the present invention is to provide a pivot, located between the foot support plate and the ground engaging plate, at a substantially fixed location which facilitates pivoting movement of the ground engaging plate relative to the foot engaging plate in at least one direction of movement, preferably two or more different directions of movement.

Still another object of the present invention is to eliminate substantially any to and fro sheering action of the bottom ground engaging plate relative to the top foot engaging plate as well substantially eliminate any Z-axis rotational movement of the ground engaging plate relative to the foot engaging plate while only substantially permitting pivoting movement of the ground engaging plate(s) relative to the foot engaging plate.

The present invention also relates to a shoe sole comprising: a rigid foot engaging plate for accommodating a foot of a user, during use of the shoe sole, so that the foot remains supported by the foot engaging plate during use of the shoe sole; at least one ground engaging plate supported by an undersurface of the foot engaging plate; and a pivot member being located between the foot engaging plate and the ground engaging plate to facilitate relative pivoting motion between the foot engaging plate and the ground engaging plate during use of the shoe sole The present invention also relates to a shoe sole comprising: a foot engaging plate for accommodating a foot of a user, the foot engaging plate being sufficiently rigid so as to resist distortion of the foot engaging plate, during use of the shoe sole, so that the foot remains supported by the foot engaging plate during use of the shoe sole; separate toe and heel ground engaging plates supported by an undersurface of the foot engaging plate in a spaced relationship from one another, the toe ground engaging plate having a pivot member located between the foot engaging plate and the toe ground engaging plate to facilitate relative pivoting motion between the toe ground engaging plate and the foot engaging plate, the heel ground engaging plate having a pivot member located between the foot engaging plate and the heel ground engaging plate to facilitate relative pivoting motion between the heel ground engaging plate and the foot engaging plate; and a layer of resilient material being sandwiched between the foot engaging plate and the toe ground engaging plate and a layer of resilient material being sandwiched between the foot engaging plate and the heel ground engaging plate.

BRIEF DESCRIPTION OF THE DRAWINGS

The invention will now be described, by way of example, with reference to the accompanying drawings in which:

FIG. 3 is a top side perspective view of the shoe sole of FIG. 1 following assembly thereof;

FIG. 3B is a bottom side perspective of the shoe sole of FIG. 1 following assembly thereof;

DETAILED DESCRIPTION OF THE INVENTION

Figure 1:
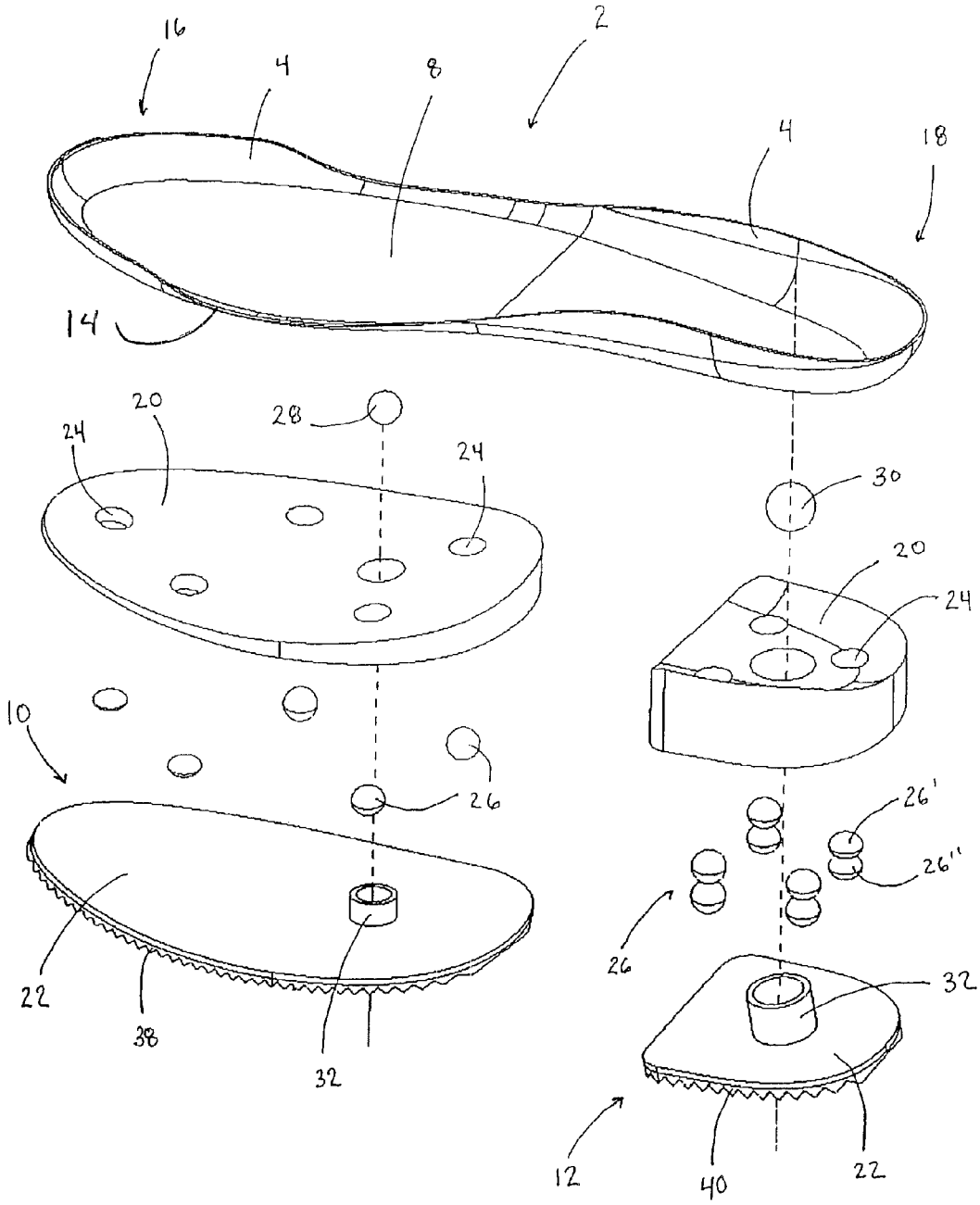
FIG. 1 is an exploded view showing the improved shoe sole according to the present invention.
Figure 2:
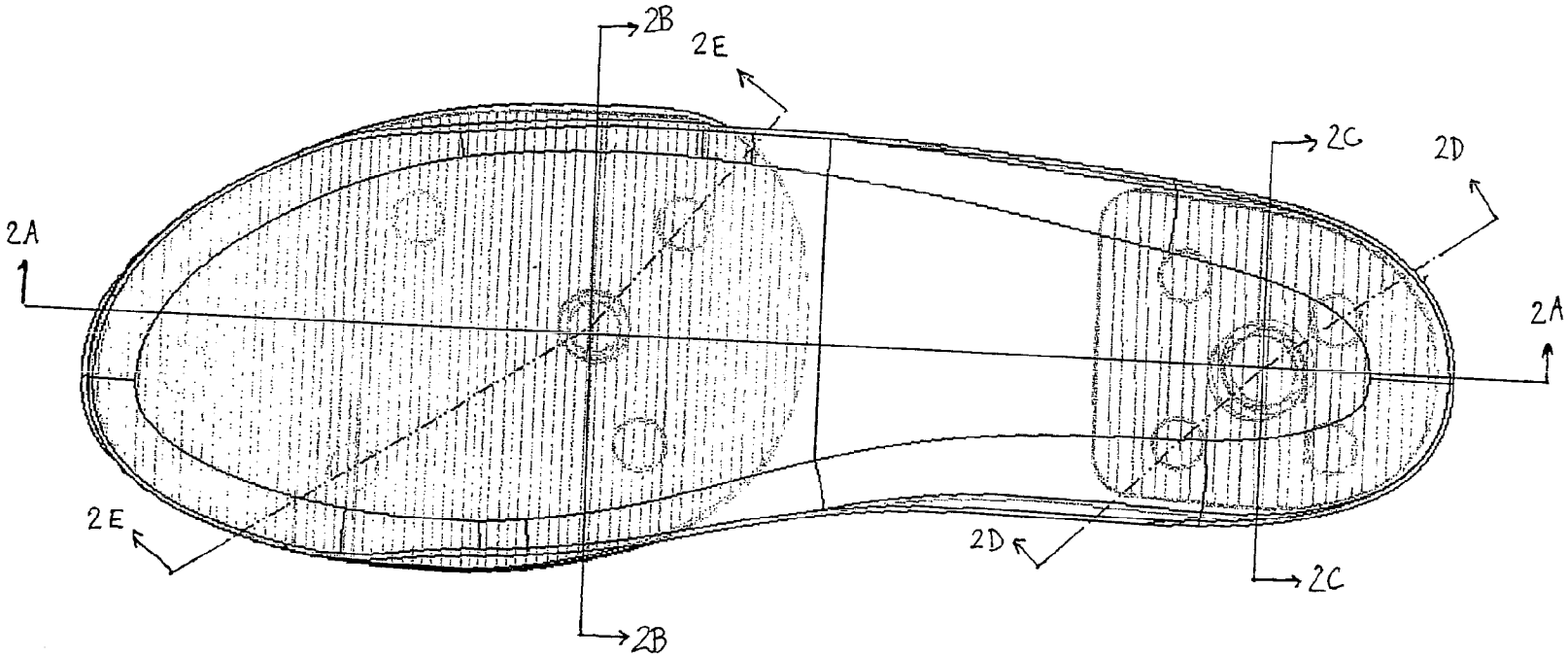
FIG. 2 is a bottom plan view of the shoe sole of FIG. 1 following assembly thereof.
Figure 2A:
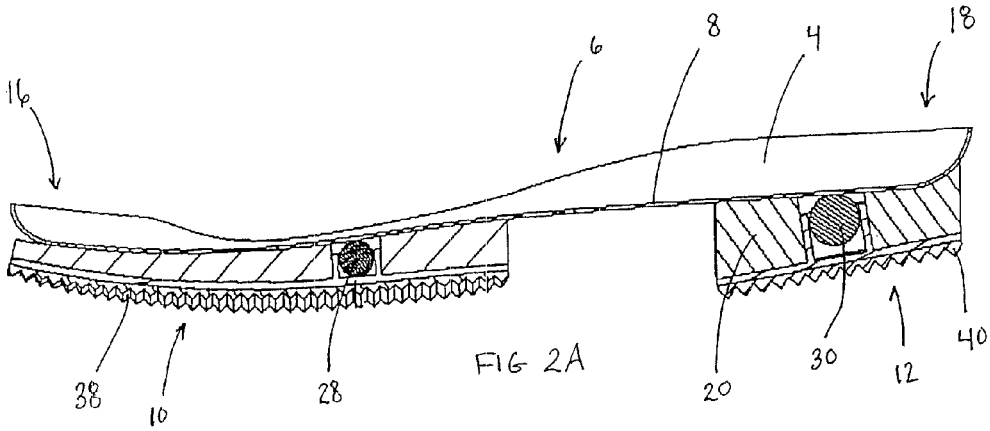
FIG. 2A is a cross-sectional view along section line 2A-2A of FIG. 2.
Figure 2B:
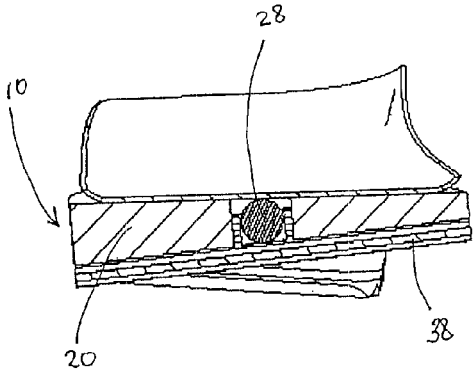
FIG. 2B is a cross-sectional view along section line 2B-2B of FIG. 2.
Figure 2C:
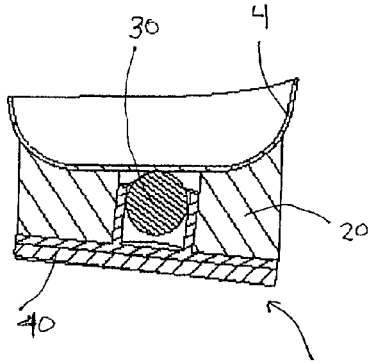
FIG. 2C is a cross-sectional view along section line 2C-2C of FIG. 2.
Figure 2D:
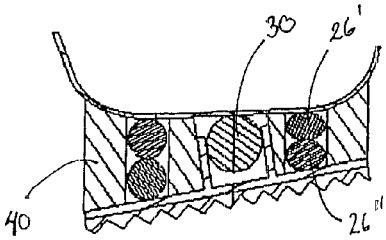
FIG. 2D is a cross-sectional view along section line 2D-2D of FIG. 2.
Figure 2E:
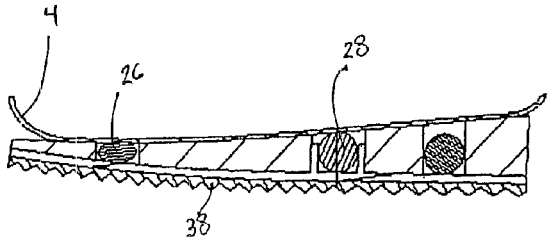
FIG. 2E is a cross-sectional view along section line 2E-2E of FIG. 2.

With reference now to FIGS. 1-2E, a detailed description concerning a first embodiment of the present invention will now be provided. As can be seen in these Figures, the foot engaging plate 2 generally comprises an elongate member which is adequately sized and shaped to support at least the heel, the arch and ball portions of a foot of a user. According to this embodiment, the foot engaging plate 2 is also sized to accommodate the toes of the user's foot and is provided with a substantially continuous contoured perimeter shroud or annular skirt 4 which helps maintain, support and retain the foot properly located and centered on the foot engaging plate 2 during use of the shoe sole 6. Preferably the foot engaging plate 2 is manufactured from a substantially rigid material, such as carbon fiber, a metal or some substantially rigid synthetic material which is designed to resist distortion and/or deflection of the foot engaging plate 2, during use thereof, so that the foot of the user is always properly and adequately supported by the foot engaging plate 2 during use of the shoe sole 6. The foot engaging plate 2 typically has a thickness of between 0.05 and 0.35 inches or so. If desired, the upwardly facing top surface 8 of the foot engaging plate 2 can be provided with a thin padding material, a liner, an odor absorbing layer or some other conventional and well known top layer to provide desired comfort to a foot of a user during use of the shoe sole 6.

A pair of toe and heel ground engaging plates 10, 12 are each pivotally attached to an undersurface 14 of the foot engaging plate 2 with the toe ground engaging plate 10 being located under the leading toe portion 16 of the foot engaging plate 2 while the heel ground engaging plate 12 being located under the trailing heel portion 18 of the foot engaging plate 2. Each one of the ground engaging plates 10, 12 typically sandwiches a layer of resilient material 20 between the upwardly facing surface 22 of the ground engaging plates 10, 12 and the lower downwardly facing undersurface 14 of the foot engaging plate 2. The layer of resilient material 20 typically has a thickness of between 0.1 and 0.5 inches or so. The layer of resilient material 20 can have a variety of different cushioning and other programming characteristics which determine the amount of pressure or force that is required to in order permit the either the toe or heel ground engaging plate 10, 12 to pivot or bias toward the foot engaging plate 2 about the fixed pivot 28 or 30. A further discussion concerning the permitted pivoting motion of the toe and/or heel ground engaging plates 10, 12, relative to the foot engaging plate 2, will be provided below.

As can be seen in FIGS. 1, 2D and 2E, for example, at least one and possibly a plurality of bores 24 are formed through the layer of resilient material 20 and each one of these bores 24 is spaced about the perimeter of the layer of resilient material 20. The size, shape, location, depth, spacing, quantity, etc., of each one of the bores 24 can vary depending upon the particular application of the shoe sole 6. Typically the bores 24 will having a diameter of between 0.1 and 0.5 inches or so and will typically extend completely through the resilient material 20, while it is possibly for the bores 24 to only extend partially through the resilient material 20.

While the layer of resilient material 20 is shown in as being a single layer, it is to be appreciated that the layer of resilient material 20 could comprise two or a plurality of different layers of different materials which overlie one another. The bores 24 may, if desired, extend though one, some or all of the layers of resilient material 20, depending upon the particular application for the shoe sole 6.

A selectable compressible member 26 is typically accommodated within each one of the bores and, depending upon the specific hardness, durometer, softness and/or other characteristics of the selectable compressible member 26, the pivoting characteristics of either the toe and/or the heel ground engaging plates 10, 12, relative to the foot engaging plate 2, can be programmed to respond in a desired manner during use of the shoe sole when utilized for a particular activity, e.g., tennis, rock climbing, running, walking, etc. Accordingly, by properly choosing the resilient material(s) 20, the number, size and location of the bores 24 and the selectable compressible member 26 to be accommodated within each one of the bores 24 in the resilient material 20, it is possible to design the shoe sole to maximize the performance of the shoe sole 6 by a particular user for virtually any activity. Suitable materials for use in manufacturing the selectable compressible 26 member comprise, for example, rubber, foam, synthetic materials and other conventional footwear materials.

As shown in FIGS. 1 and 2D, for example, the selectable compressible members 26 in the heel portion 18 of the shoe sole 6 can be stacked one on top of the other. By stacking two or more selectable compressible members 26, one on top of the other, further programming and/or variation of the performance characteristics of the shoe sole 6 can be readily achieved. For example, according to one embodiment, the first selectable compressible member 26', located adjacent the foot engaging plate 2, could be manufactured from a substantially softer and/or more resilient substance than both the second selectable compressible member 26" and the layer of resilient material 20 while the second selectable compressible member 26", located adjacent the ground engaging plate 10, 12, could be manufactured from a substantially harder material than both the first selectable compressible member 26" and the layer of resilient material 20. The first softer and/or more resilient selectable compressible member 26' will, in such instance, provide an initial cushioning effect to the foot of the user during heel impact as the user utilizes the shoe sole 6 while the second substantially harder selectable compressible member 26" will provide a less cushing effect following heel impact.

It is to be appreciated that while the selectable compressible members 26, 26', 26", according to this embodiment, are shown as being substantially spherical in shape, the selectable compressible members 26, 26', 26" could have a variety of other different shapes, sizes, configuration, e.g., they could, for example, be either cylindrical, tubular, rectangular, square, hexagonal, etc. In addition, the selectable compressible members 26, 26', 26" could be either solid, hollow or partially hollow. The actual shape, size and/or configuration of the selectable compressible members 26, 26', 26" is not critical. What is important, however, is the specific characteristics and/or properties of the selectable compressible members 26, 26', 26" along with the specific characteristics and/or properties of the layer of resilient material 20 since these characteristics and/or properties will, along with the characteristics of the fixed pivot 28 or 30, dictate the pivoting characteristics of the shoe sole 6 during use.

In order to facilitate pivoting motion of the ground engaging plates 10, 12 relative to the foot engaging plate 2, an incompressible substantially fixed pivot member 28, 30 is provided between the respective foot and ground engaging plates 10, 12. As can be seen in FIG. 1, for example, each incompressible pivot member 28, 30 is supported by an annular support 32 which is formed integral with the upwardly facing surface 22 of the respective ground engaging plates 10 or 12. Preferably, each incompressible pivot member 28 or 30 is captively retained by the respective support 32 or is formed integrally therewith. As shown in FIG. 1, the incompressible pivot member 30 for the heel ground engaging plate 12 is located substantially in a central region of the heel ground engaging plate 12 while the incompressible pivot member 28, for the toe ground engaging plate 10, is located closer to the heel portion 18 than to the toe portion 16 of the foot engaging plate 2. The reason for the variation in the location of the incompressible pivot members 28, 30 is due to the type of pivoting motion to be achieved by each ground engaging plate 10, 12 during use of the shoe sole 6. For example, as the user walks in a conventional fashion, the heel portion 18 of the shoe sole 6 is typically the first component of the shoe sole to impact the ground or some other surface. By substantially centrally locating the incompressible fixed pivot member 30 for the heel ground engaging plate 12, this allows the heel ground engaging plate 12 to sufficiently pivot rearward (see FIG. 2A) during the initial heel strike and then pivot forward and return back to its substantially parallel orientation with the foot engaging plate 2 (see FIG. 3). The toe ground engaging plate 10, on the other hand, is normally initially oriented substantially parallel to the foot engaging plate 2, as can be seen in FIG. 2A, when the toe ground engaging plate 10 initially contacts the ground or some other surface. As the user walks forward and completes his/her stride or gate, the leading portion of the toe ground engaging plate 10 compresses the adjacent layer of resilient material 20, and any selectable compressible members 26, 26' or 26" contained within a bore 24, (see FIG. 2E) so that the leading portion of the toe ground engaging plate 10 moves or pivots, about the pivot axis of the incompressible pivot member 28, toward the leading toe portion 16 of the foot engaging plate 2. Once the user's gate is completed, the layer of resilient material 20 has a tendency to re-expand and return the toe ground engaging plate 10 back to its substantially parallel position with the foot engaging plate 2 (see FIGS. 2A and 3).

It is to be appreciated that the pivoting motion, as shown in FIGS. 2A-2E, is a rolling pivot motion. That is, since the incompressible pivot members 28, 30 are spherical and engage with the undersurface 14 of the foot engaging plate 2. When the toe and heel ground engaging plates 10, 12 experience a force tending to pivot the toe and heel ground engaging plates 10, 12 relative to the foot engaging plate 2, the spherical incompressible pivot members 28, 30 will roll to and fro a small distance, along the undersurface 14 of the foot engaging plate 2, to facilitate the described pivoting motion. Alternatively, a retaining socket (not shown) could be provided on the undersurface 14 of the foot engaging plate 2 which would captively retain the spherical incompressible pivot members 28, 30 and provide a truly fixed pivot and prevent such rolling motion and only permit sliding motion about a truly fixed pivot location. In such instance, the inner surface of the socket (not shown) would be preferably be lined or coated with a low friction material, e.g., a Teflon™ coating or some other low friction substance, which will permit and facilitate the desired sliding or pivoting motion of the spherical incompressible pivot members 28, 30 relative to the socket accommodated by the undersurface 14 of the foot engaging plate 2.

Although the incompressible pivot members 28, 30 are shown, in FIGS. 1-2E, as being supported by the ground engaging plates 10, 12, it is to be appreciated that the location of the incompressible pivot members 28, 30 could be reversed. That is, the incompressible pivot members 28, 30 could be supported by the downwardly facing surface of the foot engaging plate 2 while the socket or pivot surface could be formed on the upwardly facing surface of the ground engaging plates 10, 12.

In the embodiment shown in FIG. 1, the incompressible pivot member 30, of the heel ground engaging plate 12, is spaced preferably a small distance, e.g., between 0.05 and 0.25 inches or so from the undersurface 14 of the foot engaging plate 2. This small gap or distance is sufficiently close so that the incompressible pivot member 30 is only brought into contact with the foot engaging plate 2 following heel strike of the shoe sole 6 with the ground. By initially spacing the incompressible pivot member 30 from the foot engaging plate 2, this allows the heel portion 18 of the shoe sole 6 to provide a further cushioning effect for the user's foot prior to any pivoting action of the heel ground engaging plate 12 occurring. Under other circumstances, the incompressible pivot member 28 of the toe ground engaging plate 10 will be in continuous contact with the undersurface 14 of the foot engaging plate 2.

As is conventional in the shoe industry, the lower bottom most surfaces 34, 36 of the respective toe and heel ground engaging plates 10, 12 each have or are provided with a desired gripping material or durable layer 38, 40 which is suitable for the particular application of the shoe sole 6. As is shown in FIGS. 1-2E, the conventional durable layer 38, 40, such as a rubber or some other synthetic sole, leather, or some other conventional material which is commonly used in the shoe industry, is integral with or secured to the undersurface of both of the respective toe and heel ground engaging plates 10, 12 to provide a desired gripping effect of the toe and heel ground engaging plates 10, 12 with the ground during use of the shoe sole 6.

Figure 4B:
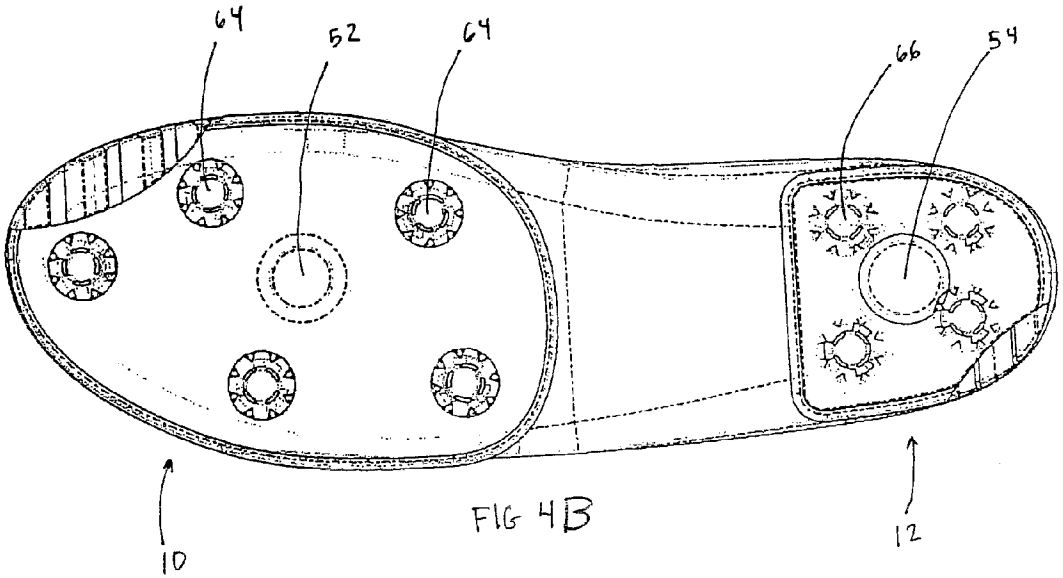
FIG. 4B is a bottom plan view of FIG. 4A.
Figure 4A:
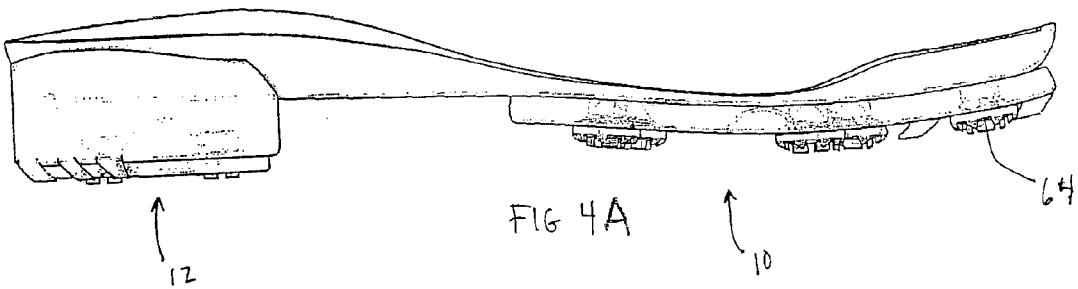
FIG. 4A is a side elevational view of a second embodiment of the improved shoe sole according to the invention.
Figure 5A:
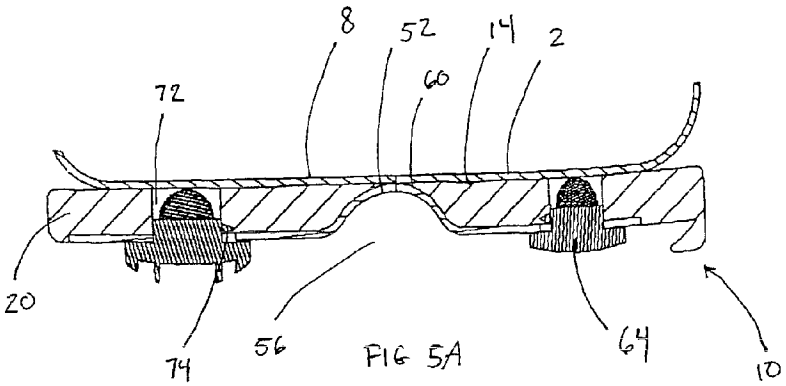
FIG. 5A is a cross-sectional view along section line 5A-5A of FIG. 4C.
Figure 5B:
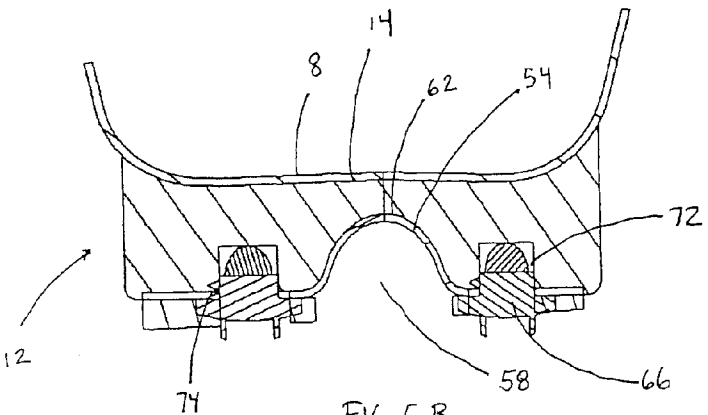
FIG. 5B is a cross-sectional view along section line 5B-5B of FIG. 4C.
Figure 4C:
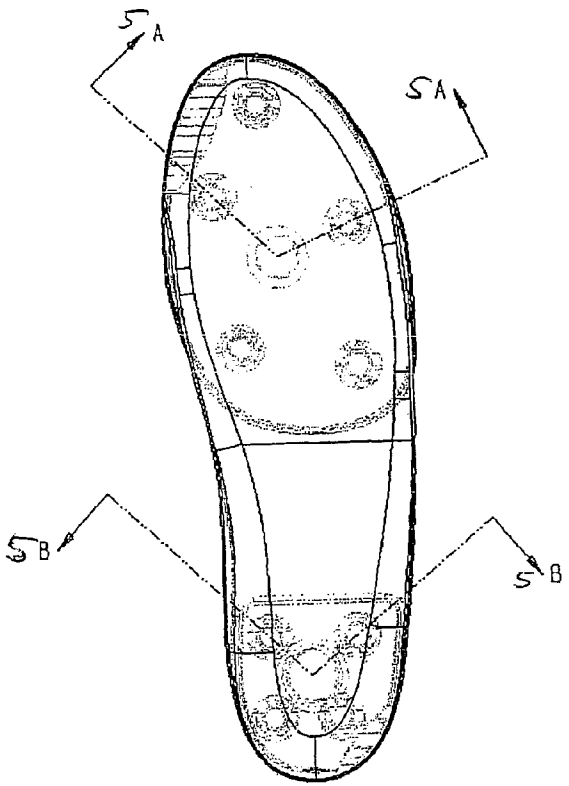
FIG. 4C is a top plan view of FIG. 4.
Figure 6A:
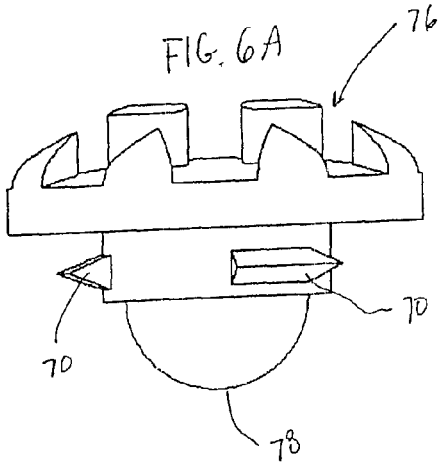
FIG. 6A is a front elevational view of a pivotal lug for a golf shoe.
Figure 6C:
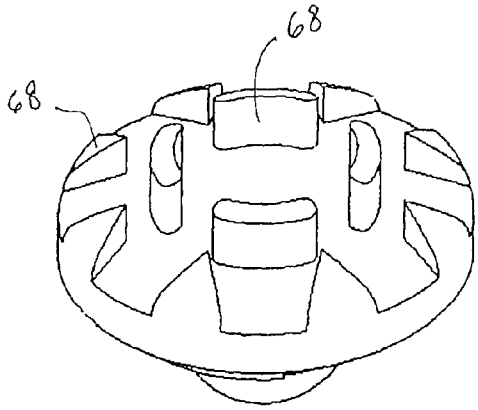
FIG. 6C is a top side perspective view of pivoting portion of the pivotal lug of FIG. 6A.
Figure 6B:
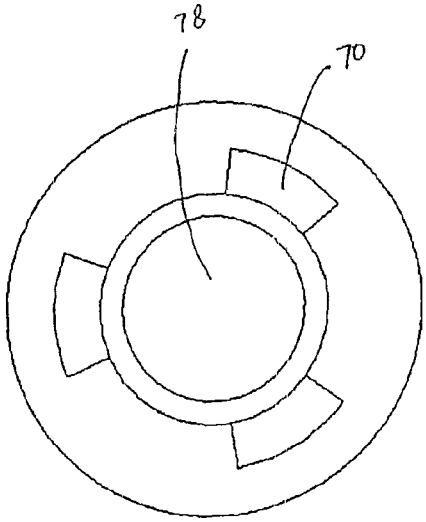
FIG. 6B is a bottom plan view of the pivotal lug of FIG. 6A.
Figure 6D:
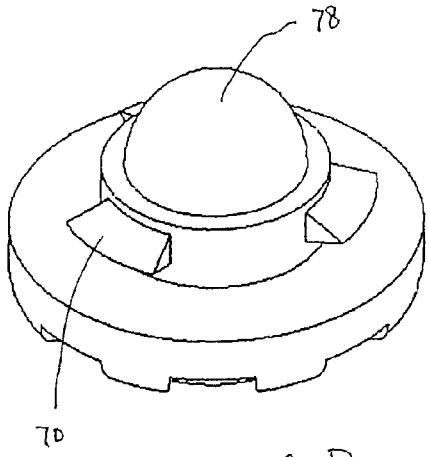
FIG. 6D is a bottom side perspective view of pivoting portion of the pivotal lug of FIG. 6A.

With reference now to FIGS. 4-6, a second embodiment of the present invention will now be described. As this embodiment is similar to the first embodiment, identical components will be provided with identical reference numerals.

It is to be appreciated that this embodiment is more specifically directed to a golf shoe. Like the previously discussed embodiment, the shoe sole 6 has a foot engaging plate 2 which is located to accommodate and support the foot of a user during use. In addition, the shoe sole 6 is provided with a toe ground engaging plate 10 and a heel ground engaging plate 12 which, like the previous embodiment, each have a respective substantially fixed pivot 52, 54, which are both generally centrally located to facilitate the desired pivoting motion of the respective toe and heel ground engaging plates 10, 12 with respect to the foot engaging plate 2. In addition, one or more layers of resilient material 20 is/are accommodated between the respective toe and heel ground engaging plates 10, 12 and the foot engaging plate 2. As with the previous embodiment, one or more holes or openings 24 may be formed in the resilient material 20, depending upon the particular application, so as to program the golf shoe to perform a particular function or motion, resist a particular function or motion, encourage a particular function or motion, etc.

According to this embodiment, the incompressible pivot members 52,54 are formed integral with the remainder of the respective toe and heel ground engaging plates 10 and 12 by forming a substantially cylindrical indentation or dome 56 or 58 in the central region thereof. The upwardly facing surface 60, 62 of the incompressible indentation or dome 56, 58 is located to engage with the undersurface 14 of the foot engaging plate 2 and provide the desired pivoting motion upon suitable compression of the layer of resilient material 20, located between the foot engaging plate 2 and the toe and the heel ground engaging plates 10 and 12, during walking, swinging, etc., as a golfer uses footwear incorporating the shoe sole 6.

As with the previous embodiment, depending upon the design specific characteristics of the shoe sole, e.g., the hardness, the softness, the durometer, etc., of the layer of resilient material 20 can be selected to suit the particular need(s) of a particular user. In addition, the thickness of the layer of the resilient material 20 and/or the layers comprising the layer of resilient material 20 can be suitably selected to achieve a desired performance characteristics.

As is conventional in the prior art, a plurality of soft spikes 64, 66 are supported by the 14 of the ground engaging plates 10, 12. As can be seen in FIG. 4A, five spaced apart soft spikes 64 are provided in the toe ground engaging plate 10 while four soft spikes 66 are provided in the heel ground engaging plate 12. As is well known in the art, each soft spike 64, 66 has a plurality of conventional gripping members 68, in an exposed top surface thereof, which form a suitable gripping tread, pattern or arrangement to facilitate gripping by the spike 64, 66 with the grass or turf during use of the golf shoe by a user. As the design of the gripping tread, pattern or arrangement is conventional and well known in the art, and does not form any part of the present invention per se, a further detailed description concerning the same is not provided.

In addition, each one of the soft spikes 64, 66 is provided with a plurality, e.g., three or four equally spaced locking lugs 70 which facilitate releasable locking engagement of the soft spikes 64, 66 with a respective spike cavity 72 provided in either the toe or the heel ground engaging plate 10, 12. That is, the rounded leading end of the soft spikes 64 or 66 is received within the respective spike cavity 72 such the that the locking lugs 70 pass through corresponding receiving slots 73 formed about the perimeter of the spike cavity 72. Once this occurs, the soft spike 64 or 66 is then rotated a desired rotational angle 30° to 120° by use of a conventional soft spike attachment tool. Following rotation of the soft spike 64 or 66 by the attachment tool, the soft spike 64 or 66 is locked relative to the toe or the heel ground engaging plate 10, 12 so that the soft spikes 64, 66 are substantially permanently retained therein until they are subsequently removed by an end user via the attachment tool or happen to fall out after a prolonged period of use.

A major difference between the soft spikes 64, 66, according to the present invention, and the soft spikes known in the prior art, is that a domed or contoured surface 78 is formed on the soft spike 64, 66, remote from the gripping tread, pattern or arrangement 76 to provide a domed pivoting surface 78 which allows the soft spike 64, 66 to pivot relative to either the toe or the heel ground engaging plates 10, 12 during use of the shoe sole. The pivoting motion of the soft spike 64, 66 helps ensure that each one of the soft spikes 64, 66, during use, is able to individually pivot relative to the grass, the ground, the sand, the cart path and/or turf so that the entire gripping tread, pattern or arrangement 76 of the soft spike 64, 66 remains in constant and continuous contact and engagement with the grass, the ground, the sand, the cart path and/or turf to provide a maximum gripping force and effect. In addition, by having a plurality of soft spikes 64, 66 which are all pivotally attached to the shoe sole 6, the soft spikes 64, 66 are readily able to adapt to variations in the terrain in order to help maintain the foot properly positioned and oriented on the top surface 8 of the foot engaging plate 2 and minimize any distortion force(s) which may be transferred or transmitted through the shoe sole 6 to the foot.

It is to be appreciated that the locking lugs 70 and gripping tread, pattern or arrangement 76 must allow for pivoting motion of the soft spikes 64, 66 relative to the foot engaging plate 2 while still captively engaging the soft spike 64, 66 within the spike cavity 72. Preferably the dome surface 78 of the soft spike 64, 66 is manufactured from a conventional substantially incompressible material, to ensure that the soft spike 64, 66 pivots, rather than is partially compressed, as the soft spike 64, 66 engages with the grass, the ground, the sand, the cart path and/or turf during use of the shoe sole 6.

Figure 7:
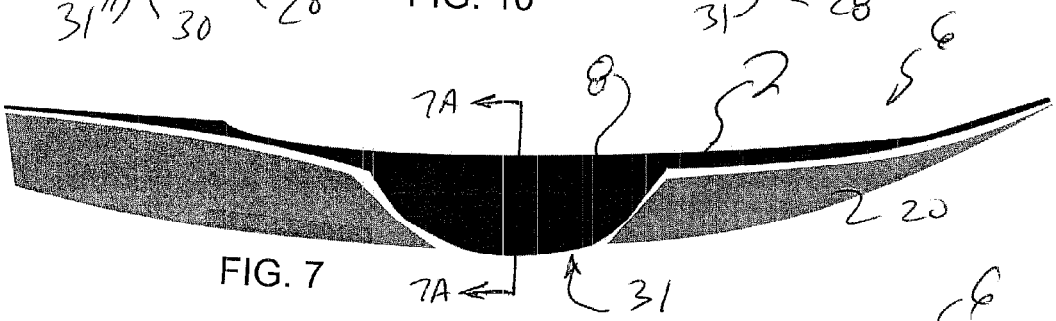
FIG. 7 is a diagrammatic view side elevational view showing a further embodiment of the improved shoe sole according to the present invention.
Figure 7A:
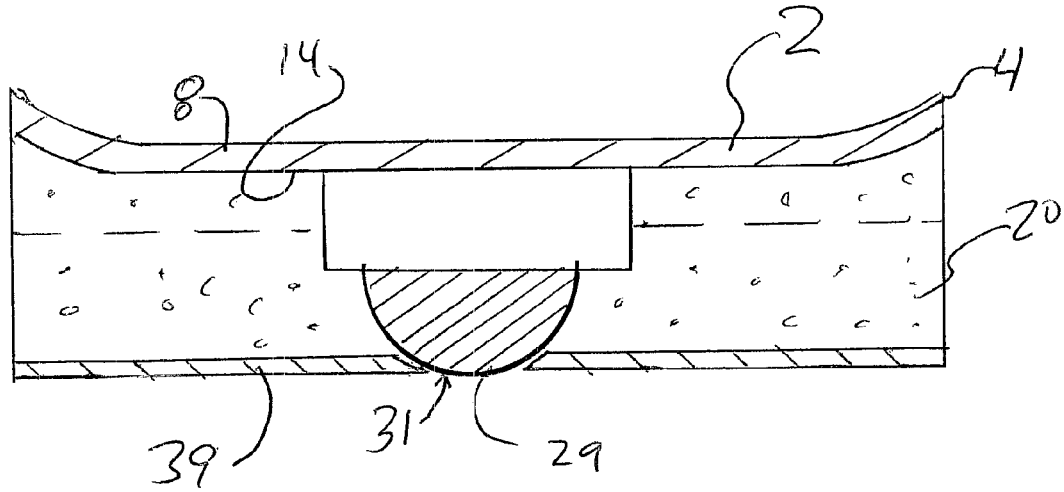
FIG. 7A is a diagrammatic cross sectional view along section line 7A-7A of FIG. 7.

With reference now to FIGS. 7 and 7A, another embodiment of the present invention will now be described. As this embodiment is similar to the first embodiment, identical components will be provided with identical reference numerals.

As with the previous embodiments, the foot engaging plate 2 is generally sized to accommodate the user's foot and is provided with a substantially continuous contoured perimeter shroud or annular skirt 4 which helps maintain, support and retain the foot properly located and centered on the foot engaging plate 2 during use of the shoe sole 6. Preferably the foot engaging plate 2 is manufactured from a substantially rigid material which is designed to resist distortion and/or deflection of the foot engaging plate 2, during use thereof, so that the foot of the user is always properly and adequately supported by the foot engaging plate 2 during use of the shoe sole 6. If desired, the upwardly facing top surface 8 of the foot engaging plate 2 can be provided with a thin padding material, a liner, an odor absorbing layer or some other conventional and well known top layer to provide desired comfort to a foot of a user during use of the shoe sole 6.

According to this embodiment, the location of the incompressible pivot member 29 is reversed to the first embodiment. That is, the single incompressible pivot member 29 is securely fastened and supported by the lower downwardly facing surface 14 of the foot engaging plate 2 for direct engagement with the ground or some other surface. Since only a single incompressible pivot member 29 is utilized, it is generally located or positioned in a central region of the foot engaging plate 2, generally between the toe and heel regions.

A layer of resilient material 20 is supported by the lower downwardly facing surface 14 of the foot engaging plate 2 for interacting with the ground or some other surface along with the single incompressible pivot member 29. The layer of resilient material 20 has a generally centrally located hole or opening 31 formed therein for surrounding and accommodating the single incompressible pivot member 29. If desired, the lower bottom most ground engaging surface of the layer of resilient material 20 may carry a desired gripping material or durable layer 39 which is suitable for the particular application of the shoe sole 6. As is shown in FIGS. 7 and 7A, a conventional durable layer 39, such as leather, rubber or some other synthetic or conventional material which is commonly used in the shoe industry, is molded integral with or permanently secured to the undersurface of layer of resilient material 20 to provide a desired gripping effect of the lower most surface of the resilient material 20 with the ground or some other surface during use of the shoe sole 6.

The layer of resilient material 20 typically has a thickness of between 0.1 and 0.5 inches or so. The layer of resilient material 20 can have a variety of different cushioning and other programming characteristics which determine the amount of pressure or force that is required to in order permit pivoting about the single pivot formed by the single incompressible pivot member 29. In addition, the layer of resilient material 20 may actually comprise two or more separate and distinct layers of which each have a desired cushioning and other programming characteristic(s) to optimize the amount of pressure or force that is required to in order permit pivoting about single incompressible pivot member 29.

As shown in FIGS. 7 and 7A, the incompressible pivot member 29 extends the same or a slightly further distance, away from the lower downwardly facing surface of the foot engaging plate 2, than the resilient material 20 so that the incompressible pivot member 29 is located for directly engaging with the ground or some other surface during use of the shoe sole. As the shoe sole contacts the ground or some other surface and pivots about the incompressible pivot member 29, the adjacent resilient material 20 is suitably compressed.

As can be seen in FIGS. 7 and 7A, a relatively small arcuate pivot section of the incompressible pivot member 29 is directly visible when viewing the bottom of the shoe sole. That is, the arcuate pivot section is coplanar with the lower most conventional durable layer 39 supported by the resilient material 20.

Figure 7B:
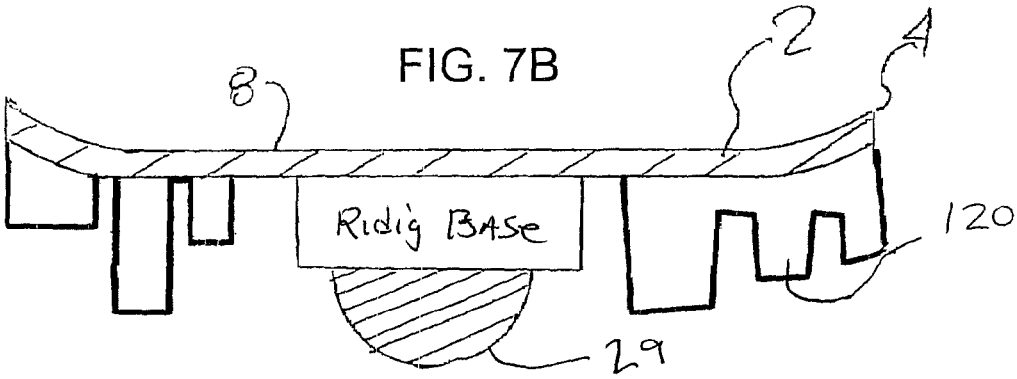
FIG. 7B is a diagrammatic cross sectional view, similar to FIG. 7A, showing a variation of the resilient sole material.

FIG. 7B is a diagrammatic cross sectional view, similar to FIG. 7A, showing a variation of the resilient sole material 120. According to this embodiment, the resilient material 120 is spaced from the incompressible pivot member 29 and comprises, for example, a conventional EVA rubber type material which has a conventional gripping contour or profile.

Figure 7C:
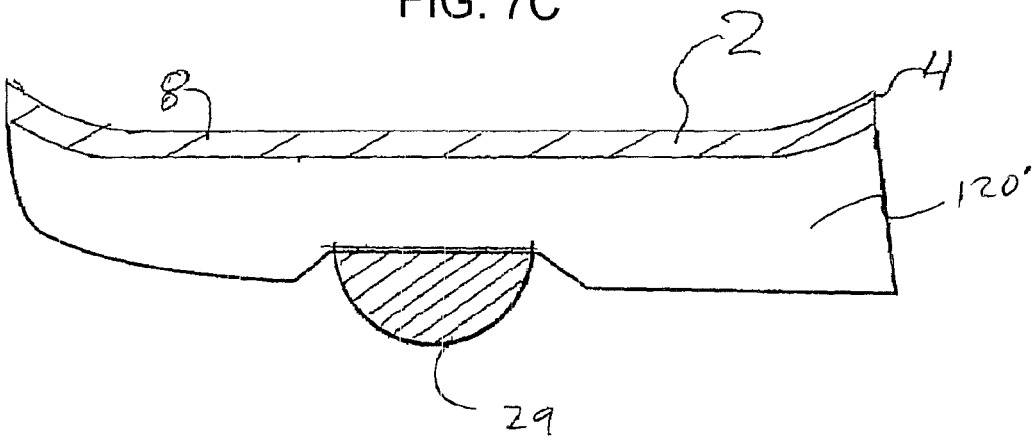
FIG. 7C is a diagrammatic cross sectional view, similar to FIG. 7A, showing a further variation of the resilient sole material.

FIG. 7C is a diagrammatic cross sectional view, similar to FIG. 7A, showing a further variation of the resilient sole material. According to this embodiment, the resilient material 120' has a varying thickness and/or shape, from the lateral to the medial side, and is formed from a conventional hard rubber material 120', for example.

Figure 7D:
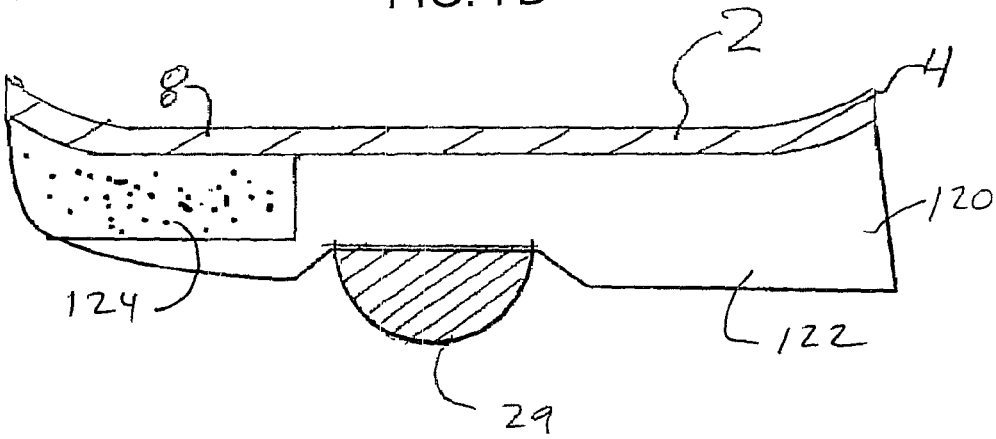
FIG. 7D is a diagrammatic cross sectional view, similar to FIG. 7C, showing a still further variation of the resilient sole material.

FIG. 7D is a diagrammatic cross sectional view, similar to FIG. 7C, showing a still further variation of the resilient sole material. According to this embodiment, the resilient material 120' has a varying thickness and/or shape, from the lateral to the medial side, and a first portion 122 of the resilient material 120' is formed from a conventional hard rubber material 120', for example, while a second portion 124 of the resilient material 120" is formed from a conventional softer rubber material 120', for example.

Figure 8:
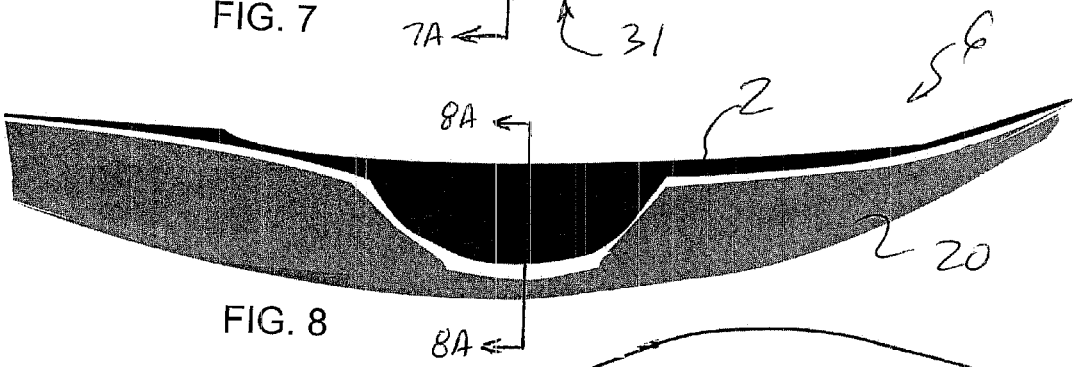
FIG. 8 is a diagrammatic view side elevational view showing another embodiment of the improved shoe sole according to the present invention.
Figure 8A:
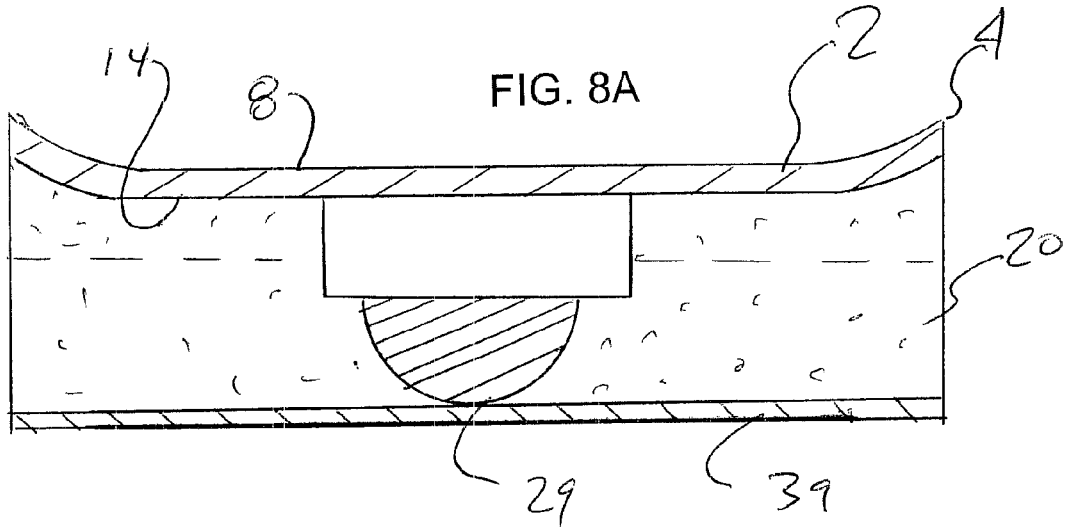
FIG. 8A is a diagrammatic cross sectional view along section line 8A-8A of FIG. 8.

With reference now to FIGS. 8 and 8A, a slight variation of FIGS. 7 and 7A will now be described. As this embodiment is similar to the embodiment of FIGS. 7 and 7A, identical components will be provided with identical reference numerals.

According to this variation, the conventional durable layer 39 extends along the entire width and length of the bottom of the shoe sole so as to completely separate the incompressible pivot member 29 from directly engaging or contacting another surface, such as the ground, during use. The conventional durable layer 39 thus prevents direct viewing of the arcuate pivot section of the incompressible pivot member 29. In all other respects, this variation is substantially the same as the embodiment shown in FIGS. 7 and 7A.

Figure 9:
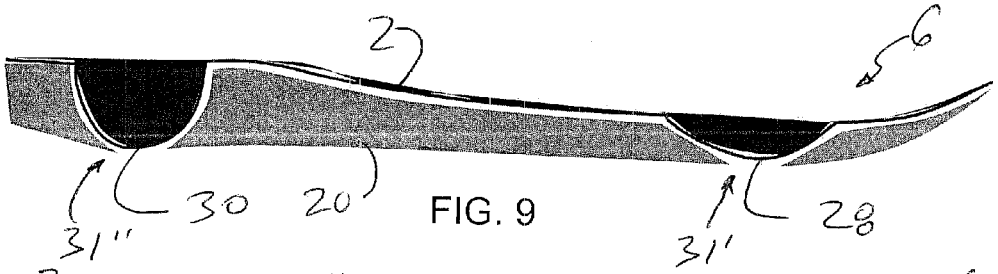
FIG. 9 is a diagrammatic view side elevational showing still another embodiment of the improved shoe sole according to the present invention.

With reference now to FIG. 9, another embodiment will now be described. As this embodiment is similar to the previous embodiments, identical components will be provided with identical reference numerals.

As with the previous embodiments, the foot engaging plate 2 is generally sized to accommodate the user's foot and is provided with a substantially continuous contoured perimeter shroud or annular skirt which helps maintain, support and retain the foot properly located and centered on the foot engaging plate 2 during use of the shoe sole 6. According to this embodiment, the location of the incompressible pivot members 28, 30 are reversed to the first embodiment. That is, both of the incompressible pivot members 28 and 30 are securely fastened and supported by the lower downwardly facing surface of the foot engaging plate 2 for direct engagement with a desired surface, such as the ground. That is, a toe incompressible pivot member 28 and a separate heel incompressible pivot member 30 are utilized and the toe incompressible pivot member 28 is generally centrally located in the toe region of the foot engaging plate 2 and the heel incompressible pivot member 30 is generally centrally located in the heel region of the foot engaging plate 2.

A layer of resilient material 20 is supported by the lower downwardly facing surface of the foot engaging plate 2 for interacting with the ground or some other surface. The layer of resilient material 20 has at least two holes or openings 31', 31" formed therein for surrounding and accommodating each one of the incompressible pivot members 28 and 30. If desired, the lower bottom most engaging surface of the layer of resilient material 20 may carry a desired gripping material or durable layer (not shown) which is suitable for the particular application of the shoe sole 6, such as leather, rubber, or some other synthetic or conventional material which is commonly used in the shoe industry, to provide a desired gripping effect of the lower most surface of the resilient material 20 with the ground or some other surface during use of the shoe sole 6.

The layer of resilient material 20 typically has a thickness of between 0.1 and 0.5 inches or so. The layer of resilient material 20 can have a variety of different cushioning and other programming characteristics which determine the amount of pressure or force that is required to in order permit pivoting about both of the fixed pivots 28 or 30. In addition, the layer of resilient material 20 may actually comprise two or more separate and distinct layers of which each have a desired cushioning and other programming characteristic to optimize the amount of pressure or force that is required to in order permit pivoting about one or both of the fixed pivots 28 or 30.

As shown in FIG. 9, the incompressible pivot members 28 and 30 extend substantially the same distance from the lower downwardly facing surface of the foot engaging plate 2 as the resilient material 20 so that the incompressible pivot members 28 and 30 are both substantially coplanar with the lower most surface of the resilient material 20.

Figure 10:
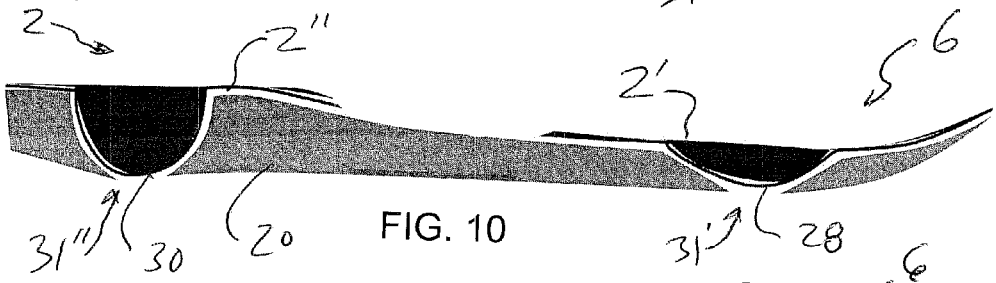
FIG. 10 is a diagrammatic view side elevational showing a still further embodiment of the improved shoe sole according to the present invention.

With reference now to FIG. 10, a slight variation of the embodiment of FIG. 9 will now be described. Although the foot engaging plate 2 is still generally sized to accommodate the user's foot, according to this embodiment, the foot engaging plate 2 is formed as two separate components. That is, the first component 2' is located for supporting the toes of a user of the shoe sole while the second component 2" is located for supporting the heel a user of the shoe sole. In addition, the toe incompressible pivot member 28 is securely fastened and supported by the lower downwardly facing surface of the first component 2' of the foot engaging plate 2 for engagement with a desired surface, such as the ground, while the heel incompressible pivot member 30 is securely fastened and supported by the lower downwardly facing surface of the second component 2" of the foot engaging plate 2 for engagement with a desired surface, such as the ground. In all other respects, this embodiment is substantially the same as the embodiment shown in FIG. 9.

Figure 11:
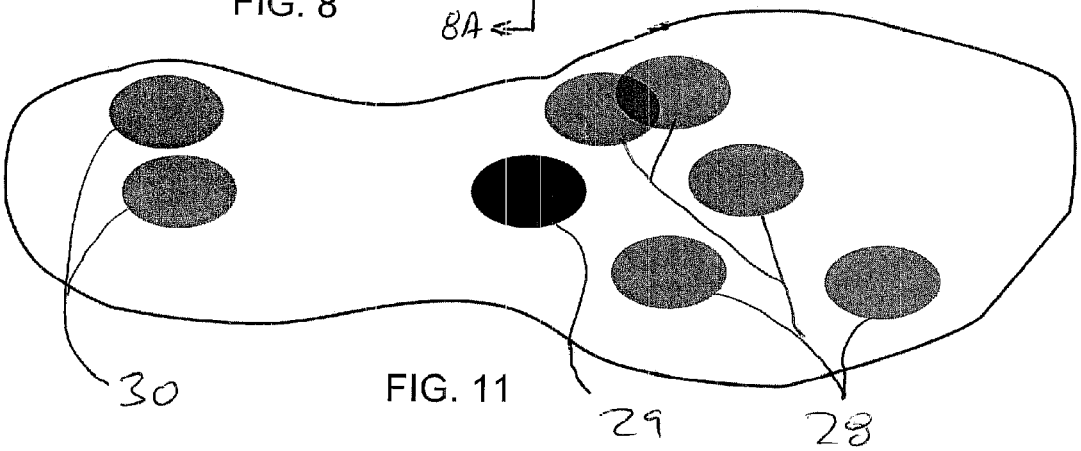
FIG. 11 is a diagrammatic bottom view showing a variety of different locations for positioning the incompressible pivot.

With reference now to FIG. 11, a diagrammatic bottom view of a shoe sole is shown which depicts a variety of different locations for positioning the incompressible pivots 28, 29 and/or 30. That is, the incompressible pivots 28, 29 and/or 30 may be centrally located, centrally located in the heel section 74, centrally located in the toe section, or medially and/or laterally located depending upon the special needs and/or requirements of the user of the shoe sole.

Figure 12A:
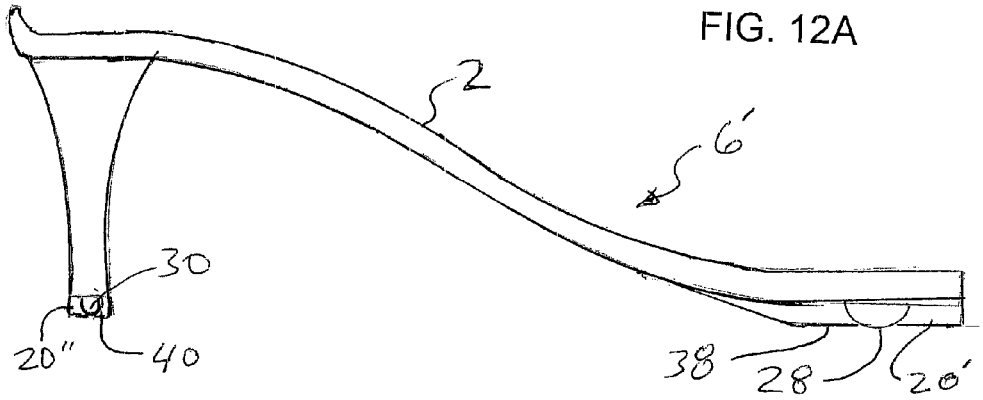
FIG. 12A is a diagrammatic side elevational view showing an embodiment of the improved shoe sole for use in a woman's high heel shoe.

With reference now to FIG. 12A, embodiment of the invention for incorporation into a high heel woman's shoe 6' will now be described. As this embodiment is similar to the previous embodiments, identical components will be provided with identical reference numerals.

As with the previous embodiments, the foot engaging plate 2 is generally sized and contoured to accommodate the user's foot and is provided with a continuous support for the foot for retaining the foot properly positioned and supported on the foot engaging plate 2 during use of the shoe sole 6'. According to this embodiment, the incompressible pivot members 28 and 30 are securely fastened and supported by the lower downwardly facing surface of the foot engaging plate 2 for direct engagement with a desired surface, such as the ground. That is, a toe incompressible pivot member 28 and a separate heel incompressible pivot member 30 are utilized and the toe incompressible pivot member 28 is generally centrally located in the toe region of the foot engaging plate 2 and the heel incompressible pivot member 30 is centrally located at the base of the elongated tapering heel section 74 which is directly supported by the foot engaging plate 2.

One layer of resilient material 20' is supported by the lower downwardly facing surface of the foot engaging plate 2 for interacting with the ground or some other surface while a second layer of resilient material 20" is supported by the lower downwardly facing surface of the base of the elongated tapering heel section 74. Each layer of resilient material 20', 20" has at least one hole or opening formed therein for surrounding and accommodating the associated incompressible pivot member 28 or 30. If desired, the lower bottom most ground engaging surface of the layer of resilient material 20', 20" may carry a desired gripping material or durable layer 38, 40 which is suitable for the particular application of the shoe sole 6'. As is shown in FIG. 12A, a conventional durable layer 38, 40, such as leather, rubber, or some other synthetic or conventional material which is commonly used in the shoe industry, is molded integral with or permanently secured to the undersurface of layer of resilient material 20', 20" to provide a desired gripping effect of the lower most surface of the layers of resilient material 20', 20" with the ground during use of the shoe sole 6.

As with the previous embodiments, the layers of resilient material 20', 20" can have a variety of different cushioning and other programming characteristics which determine the amount of pressure or force that is required to in order permit pivoting about both of the fixed pivots 28 or 30. In addition, the layers of resilient material 20', 20" may actually comprise two or more separate and distinct layers of which each have a desired cushioning and other programming characteristic to optimize the amount of pressure or force that is required to in order permit pivoting about one or both of the fixed pivots 28 or 30.

As with the previous embodiments, the incompressible pivot members 28 and 30 may extend either less, a further distance or substantially the same distance from the lower downwardly facing surface of the foot engaging plate 2 as the resilient material 20', 20", depending upon the particular application, so that the incompressible pivot members 28 and 30 are extend a smaller distance, a further distance or are both substantially coplanar with the lower most conventional durable layers 38, 40 supported by the resilient material 20', 20".

Figure 12B:
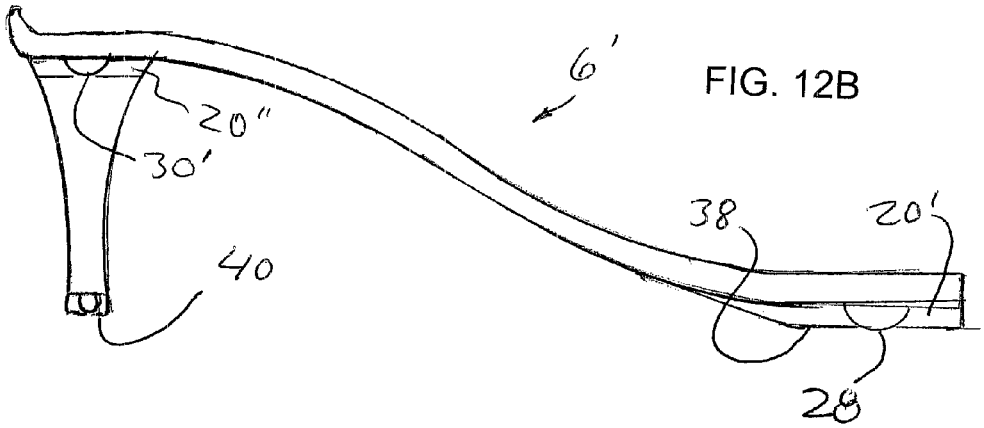
FIG. 12B is a diagrammatic side elevational view showing a variation of the woman's high heel shoe of FIG. 12A.

With reference now to FIG. 12B, a slight variation of the embodiment of FIG. 12A will now be described. As this embodiment is similar to the previous embodiments, identical components will be provided with identical reference numerals. According to this embodiment, the position of the heel incompressible pivot member is altered. That is, the heel incompressible pivot member 30' is located between a top most portion of the elongated tapering heel section 74 to facilitate pivotal engagement of the elongated tapering heel section 74 with the foot engaging plate 2. In all other respects, this embodiment is substantially the same as the embodiment shown in FIG. 12A.

Figure 12C:
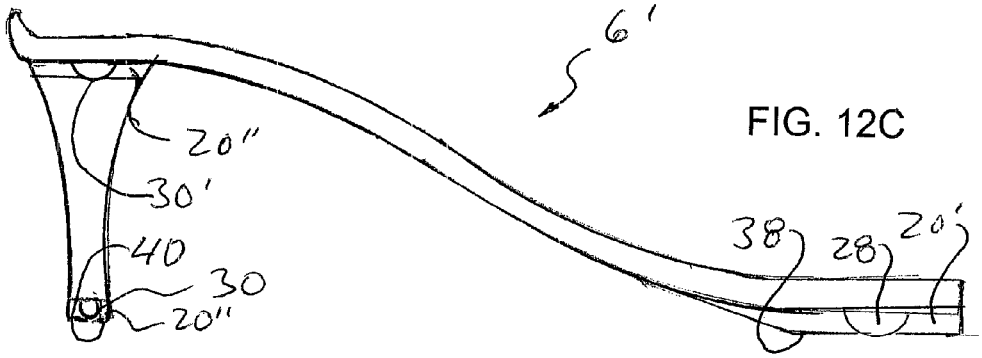
FIG. 12C is a diagrammatic side elevational view showing a still further variation of the woman's high heel shoe of FIG. 12A.

With reference now to FIG. 12C, a further variation of the embodiment of FIG. 12A will now be described. As this embodiment is similar to the previous embodiments of FIGS. 12A and 12B, identical components will be provided with identical reference numerals. According to this embodiment, there are a pair of heel incompressible pivot member 30, 30'. That is, a first one of the heel incompressible pivot member 30' is located between a top most portion of the elongated tapering heel section 74 to facilitate pivotal engagement of the elongated tapering heel section 74 with the foot engaging plate 2 while a second one of the heel incompressible pivot member 30 is located at a bottom most portion of the elongated tapering heel section 74 to facilitate pivotal engagement of the elongated tapering heel section 74 with the ground or some other surface, during use of the shoe sole 6'. In all other respects, this embodiment is substantially the same as the embodiment shown in FIGS. 12A and 12B.

While the incompressible pivot is generally shown as being substantially arcuate or spherical in shape, it is to be appreciated that the incompressible pivot may be elongated in one direction to minimize and/or eliminate pivoting in a direction lying normal to the elongate length of the pivot.

The term "shoe sole", as used within this patent application, is to be construed broadly and encompass a variety of different kinds of footwear such as, shoes, sneakers, running shoes, training shoes, golf shoes, tennis shoes, dress shoes, high heels, boots, ski boots, snow board boots, etc.

In all of the above discussed embodiments, although the incompressible pivot members 28, 29, 30 may only be shown in one arrangement, it is to be appreciated that the location of the incompressible pivot members 28, 29, 30 could be reversed. That is, the incompressible pivot members 28, 29, 30 could be supported by the opposed surface without departing form the spirit and scope of the present invention.

Since certain changes may be made in the above described shoe sole, without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. A shoe sole comprising:

a foot engaging plate for accommodating and supporting a foot of a user, the foot engaging plate being sufficiently rigid so as to support the foot and resist distortion of the foot engaging plate, during use of the shoe sole, so that the foot remains supported by the foot engaging plate during use of the shoe sole;

at least one ground engaging plate spaced from an undersurface of the foot engaging plate;

a single incompressible pivot member having a domed portion and being located between the foot engaging plate and the at least one ground engaging plate to facilitate spacing and relative pivoting motion, between the foot engaging plate and the at least one ground engaging plate, about the domed portion of the incompressible pivot member;

an annular support being fixedly supported by one of a top surface of the at least one ground engaging plate and a bottom surface of the foot engaging plate, and the annular support retaining the single incompressible pivot member such that the domed portion facilitates the pivoting motion; and a resilient material located between the foot engaging plate and the at least one ground engaging plate to facilitate relative pivoting motion, between the foot engaging plate and the at least one ground engaging plate, about the incompressible pivot member.

2. The shoe sole according to claim 1, wherein the resilient material has at least one bore formed therein.

3. The shoe sole according to claim 1, wherein the resilient material has a plurality of bores formed therein.

4. The shoe sole according to claim 3, wherein at least some of the plurality of bores formed in the resilient material accommodate a compressible material therein to facilitate programming of a desired compression characteristic for the shoe sole.

5. The shoe sole according to claim 4, wherein at least one of the bores contains at least two compressible members, stacked one on top of the other, to provide a desired compression characteristic for the shoe sole.

6. The shoe sole according to claim 4, wherein both the foot engaging plate and the at least one ground engaging plate are both manufactured from one of a carbon fiber, a metal and a synthetic material which supports the foot and resists distortion and deflection of the foot engaging plate.

7. The shoe sole according to claim 1, wherein the shoe sole has a toe ground engaging plate supported by the undersurface of the foot engaging plate and a heel ground engaging plate supported by the undersurface of the foot engaging plate;

the toe ground engaging plate has a separate single incompressible pivot member which facilitates relative pivoting motion, between the foot engaging plate and the toe ground engaging plate, about the separate single incompressible pivot member, with a layer of the resilient material being sandwiched there between; and the heel ground engaging plate has a separate single incompressible pivot member which facilitates relative pivoting motion, between the foot engaging plate and the heel ground engaging plate, about the separate single incompressible pivot member, with a layer of the resilient material being sandwiched there between.

8. The shoe sole according to claim 1, wherein the resilient material located between the toe ground engaging plate and the foot engaging plate has at least one bore formed therein and at least one compressible material is accommodated within the at least one bore to facilitate programming of a desired compression characteristic for the shoe sole, and the resilient material located between the heel ground engaging plate and the foot engaging plate has at least one bore formed therein and at least one compressible material is accommodated within the at least one bore to facilitate programming of a desired compression characteristic for the shoe sole.

9. A shoe sole comprising:

a foot engaging plate for accommodating a foot of a user, the foot engaging plate being sufficiently rigid so as to resist distortion of the foot engaging plate, during use of the shoe sole, so that the foot remains supported by the foot engaging plate during use of the shoe sole;

a toe ground engaging plate and a separate heel ground engaging plate both being supported by an undersurface of the foot engaging plate in a spaced relationship from one another and being spaced from and movable independent of one another, the toe ground engaging plate having a single incompressible pivot member having a domed portion and being located between the foot engaging plate and the toe ground engaging plate to facilitate relative pivoting motion, about the domed portion of the incompressible pivot member, between the toe ground engaging plate and the foot engaging plate and an annular support fixedly supported by one of a top surface of the toe ground engaging plate and a bottom surface of the foot engaging plate and the annular support being one of captively retained and formed integrally with the single incompressible pivot member of the toe ground engaging plate to prevent movement of the single incompressible pivot member of the toe ground engaging plate, the heel ground engaging plate having a single incompressible pivot member located between the foot engaging plate and the heel ground engaging plate to facilitate relative pivoting motion between the heel ground engaging plate and the foot engaging plate and an annular support being fixedly supported by one of a top surface of the heel ground engaging plate and the bottom surface of the foot engaging plate and the annular support being one of captively retained and formed integrally with the single incompressible pivot member of the heel ground engaging plate to prevent movement of the single incompressible pivot member of the heel ground engaging plate; and a resilient material being located between the foot engaging plate and the toe ground engaging plate to facilitate the relative pivoting motion, between the foot engaging plate and the toe ground engaging plate about the incompressible pivot member located there between, and a resilient material being located between the foot engaging plate and the heel ground engaging plate to facilitate the relative pivoting motion, between the foot engaging plate and the heel ground engaging plate, about the incompressible pivot member located there between.

10. A shoe sole comprising:

a rigid foot engaging plate for accommodating a foot of a user, during use of the shoe sole, so that the foot remains supported by the foot engaging plate during use of the shoe sole;

at least one ground engaging plate supported by an undersurface of the foot engaging plate;

an incompressible pivot member having a domed portion, the incompressible pivot member being located between the foot engaging plate and the at least one ground engaging plate to facilitate relative pivoting motion, between the foot engaging plate and the ground engaging plate during use of the shoe sole, about the domed portion of the incompressible pivot member; and an annular support fixedly supported by one of a top surface of the at least one ground engaging plate and a bottom surface of the foot engaging plate and the annular support retaining the single incompressible pivot member to prevent movement of the single incompressible pivot member.

11. The shoe sole according to claim 1, wherein the annular support captively retains the single incompressible pivot member.

12. The shoe sole according to claim 1, wherein the single incompressible pivot member is formed integrally with the annular support.

13. A shoe sole comprising:

a foot engaging plate for accommodating a foot of a user, the foot engaging plate being sufficiently rigid so as to resist distortion of the foot engaging plate, during use of the shoe sole, so that the foot remains supported by the foot engaging plate during use of the shoe sole;

a toe ground engaging plate and a heel ground engaging plate both being supported by an undersurface of the foot engaging plate in a spaced relationship from one another and being movable independent of one another;

an annular support being fixedly supported by one of a top surface of the toe ground engaging plate and a bottom surface of the foot engaging plate, the annular support being formed integrally with a single incompressible pivot member of the toe ground engaging plate, and the single incompressible pivot member of the toe ground engaging plate having a domed portion and being located between the foot engaging plate and the toe ground engaging plate to facilitate relative pivoting motion between the toe ground engaging plate and the foot engaging plate about the domed portion of the incompressible pivot member of the toe ground engaging plate;

an annular support being fixedly supported by one of a top surface of the heel ground engaging plate and the bottom surface of the foot engaging plate, and the annular support being formed integrally with a single incompressible pivot member of the heel ground engaging plate, and the single incompressible pivot member of the heel ground engaging plate having a domed portion and being located between the foot engaging plate and the heel ground engaging plate to facilitate relative pivoting motion between the heel ground engaging plate and the foot engaging plate about the domed portion of the incompressible pivot member of the heel ground engaging plate; and a resilient material being located between the foot engaging plate and the toe ground engaging plate and surrounding the single incompressible pivot member of the toe ground engaging plate to permit the relative pivoting motion, between the foot engaging plate and the toe ground engaging plate about the single incompressible pivot member located there between, and a resilient material being located between the foot engaging plate and the heel ground engaging plate and surrounding the single incompressible pivot member of the heel ground engaging plate to permit relative pivoting motion, between the foot engaging plate and the heel ground engaging plate, about the single incompressible pivot member located there between.

14. A shoe sole comprising:

a foot engaging plate for accommodating a foot of a user, the foot engaging plate being sufficiently rigid so as to resist distortion of the foot engaging plate, during use of the shoe sole, so that the foot remains supported by the foot engaging plate during use of the shoe sole;

a toe ground engaging plate and a heel ground engaging plate both being supported by an undersurface of the foot engaging plate in a spaced relationship from one another and being movable independent of one another;

an annular support being fixedly supported by one of a top surface of the toe ground engaging plate and a bottom surface of the foot engaging plate, the annular support being formed integrally with a single incompressible pivot member of the toe ground engaging plate, and the single incompressible pivot member of the toe ground engaging plate having a domed portion and being located between the foot engaging plate and the toe ground engaging plate to facilitate relative pivoting motion between the toe ground engaging plate and the foot engaging plate about the domed portion of the incompressible pivot member of the toe ground engaging plate;

an annular support being fixedly supported by one of a top surface of the heel ground engaging plate and the bottom surface of the foot engaging plate, and the annular support being formed integrally with a single incompressible pivot member of the heel ground engaging plate, and the single incompressible pivot member of the heel ground engaging plate having a domed portion and being located between the foot engaging plate and the heel ground engaging plate to facilitate relative pivoting motion between the heel ground engaging plate and the foot engaging plate about the domed portion of the incompressible pivot member of the heel ground engaging plate; and a resilient material being located between the foot engaging plate and the toe ground engaging plate and surrounding the single incompressible pivot member of the toe ground engaging plate to permit the relative pivoting motion, between the foot engaging plate and the toe ground engaging plate about the single incompressible pivot member located there between, at least one bore being formed within resilient material located between the foot engaging plate and the toe ground engaging plate, and at least one compressible member being located within the at least one being formed within resilient material located between the foot engaging plate and the toe ground engaging plate; and a resilient material being located between the foot engaging plate and the heel ground engaging plate and surrounding the single incompressible pivot member of the heel ground engaging plate to permit relative pivoting motion, between the foot engaging plate and the heel ground engaging plate, about the single incompressible pivot member located there between, at least one bore being formed within resilient material located between the foot engaging plate and the heel ground engaging plate, and at least one compressible member being located within the at least one being formed within resilient material located between the foot engaging plate and the heel ground engaging plate.

15. The shoe sole according to claim 14, wherein the resilient material has a plurality of bores formed therein and at least some of the plurality of bores formed in the resilient material accommodate a compressible material therein to facilitate programming of a desired compression characteristic for the shoe sole.

16. The shoe sole according to claim 15, wherein at least one of the bores contains at least two compressible members, stacked one on top of the other, to provide a desired compression characteristic for the shoe sole.

17. The shoe sole according to claim 14, wherein both the foot engaging plate and the at least one ground engaging plate are both manufactured from one of a carbon fiber, a metal and a synthetic material which supports the foot and resists distortion and deflection of the foot engaging plate.

18. The shoe sole according to claim 1, wherein the annular support and the single incompressible pivot maintain a constant spacing between the foot engaging plate and the at least one ground engaging plate along a pivot axis of the single incompressible pivot

19. The shoe sole according to claim 14, wherein the annular support and the single incompressible pivot of the toe ground engaging plate maintain a constant spacing between the foot engaging plate and the toe ground engaging plate along a pivot axis of the single incompressible pivot of the toe ground engaging plate, and the annular support and the single incompressible pivot of the heel ground engaging plate maintain a constant spacing between the foot engaging plate and the heel ground engaging plate along a pivot axis of the single incompressible pivot of the heel ground engaging plate.

* * * * *